United States Patent [19]

Avellino et al.

[11] Patent Number: 4,547,891

[45] Date of Patent: Oct. 15, 1985

[54] APPARATUS FOR MONITORING THE PERFORMANCE OF A PRESS OR LIKE MACHINE

[75] Inventors: Frank J. Avellino, Russell; Robert R. Johnson, Ludlow, both of Pa.

[73] Assignee: GTE Products Corporation, Stamford, Conn.

[21] Appl. No.: 559,541

[22] Filed: Dec. 8, 1983

[51] Int. Cl.[4] ..... G07C 3/10

[52] U.S. Cl. ..... 377/16; 377/39

[58] Field of Search ..... 377/16, 15, 39, 19, 377/20; 307/234; 364/149

[56] References Cited

U.S. PATENT DOCUMENTS

| | | | |
|---|---|---|---|
| 2,469,655 | 5/1949 | Leathers | 377/16 |
| 3,670,147 | 6/1972 | Wright | 377/15 |
| 4,049,952 | 9/1977 | Forsslund | 377/16 |
| 4,142,238 | 2/1979 | Brandt et al. | 377/16 |
| 4,380,801 | 4/1983 | Motomura et al. | 377/16 |

*Primary Examiner*—John S. Heyman
*Assistant Examiner*—K. Ohralik
*Attorney, Agent, or Firm*—John A. Odozynski; William H. McNeill

[57] ABSTRACT

An apparatus for monitoring the operation of a press provides outputs indicating the total number of hits and the operating speed of the press as well as the total amount of product produced by the press.

Specifically, an N-Pulser is driven by a proximity switch coupled to the press so as to fill an accumulator that maintains a running total of the amount of product produced. The N-Pulser includes a gate that has an enabling input coupled to the proximity switch and a signal input coupled to a clock. When the gate is enabled the output of the clock is permitted to pass through the gate to the input of a counter, the counter having been preset to a state determined by the amount of product produced during each cycle of the press. The gate is disabled when the counter has counted to a predetermined, ZERO, state. The output of the gate is in a parallel fashion coupled to the accumulator, so that a specified number of pulses are dumped into the accumulator as a result of each cycle of the press. In this manner a running total of product is maintained.

2 Claims, 1 Drawing Figure

APPARATUS FOR MONITORING THE PERFORMANCE OF A PRESS OR LIKE MACHINE

TECHNICAL FIELD

The invention relates to electronic instrumentation for monitoring the performance of a punch press or similar machinery.

BACKGROUND OF THE INVENTION

Prior to this invention, the total number of strokes of a press was observed, counted and then, via a look-up chart, converted to an equivalent total volume of product produced. This procedure was considered inconvenient, inefficient and error-afflicted. What was desired was a direct and automatic display of, inter alia, the total number of strokes completed by the press, the operating speed of the press, and the total amount of product produced. In addition it was desired that the relevant information be readily available for inspection by an operator.

SUMMARY OF THE INVENTION

It is an object of the invention to provide a direct and automatic display of the operation of a press.

The above and other objects, advantages, and capabilities are achieved in one aspect of the invention by an electronic apparatus for monitoring the performance of a press or similar machine. The apparatus includes a mechanism, for example, a proximity switch, coupled to the press in a manner that indicates the occurrence of a stroke of the press. An event counter and a tachometer are coupled to the proximity switch so as to respectively indicate the total number of strokes completed by the press as well as the rate at which the press executes strokes. In addition an N-Pulser is driven by the proximity switch so as to fill an accumulator that maintains a running total of the amount of product produced. The N-Pulser includes a gate that has an enabling input coupled to the proximity switch and a signal input coupled to a clock. When the gate is enabled, the output of the clock is permitted to pass through the gate to the input of a counter, the counter having been preset to a digital state determined by the amount of product produced during each cycle of the press. The gate is disabled when the counter has counted to a predetermined, ZERO, state. The output of the gate is in a parallel fashion coupled to the accumulator concomitantly with each cycle of the press. In this manner a running total of product is maintained.

DISCLOSURE OF THE PREFERRED EMBODIMENT

Figure 1:
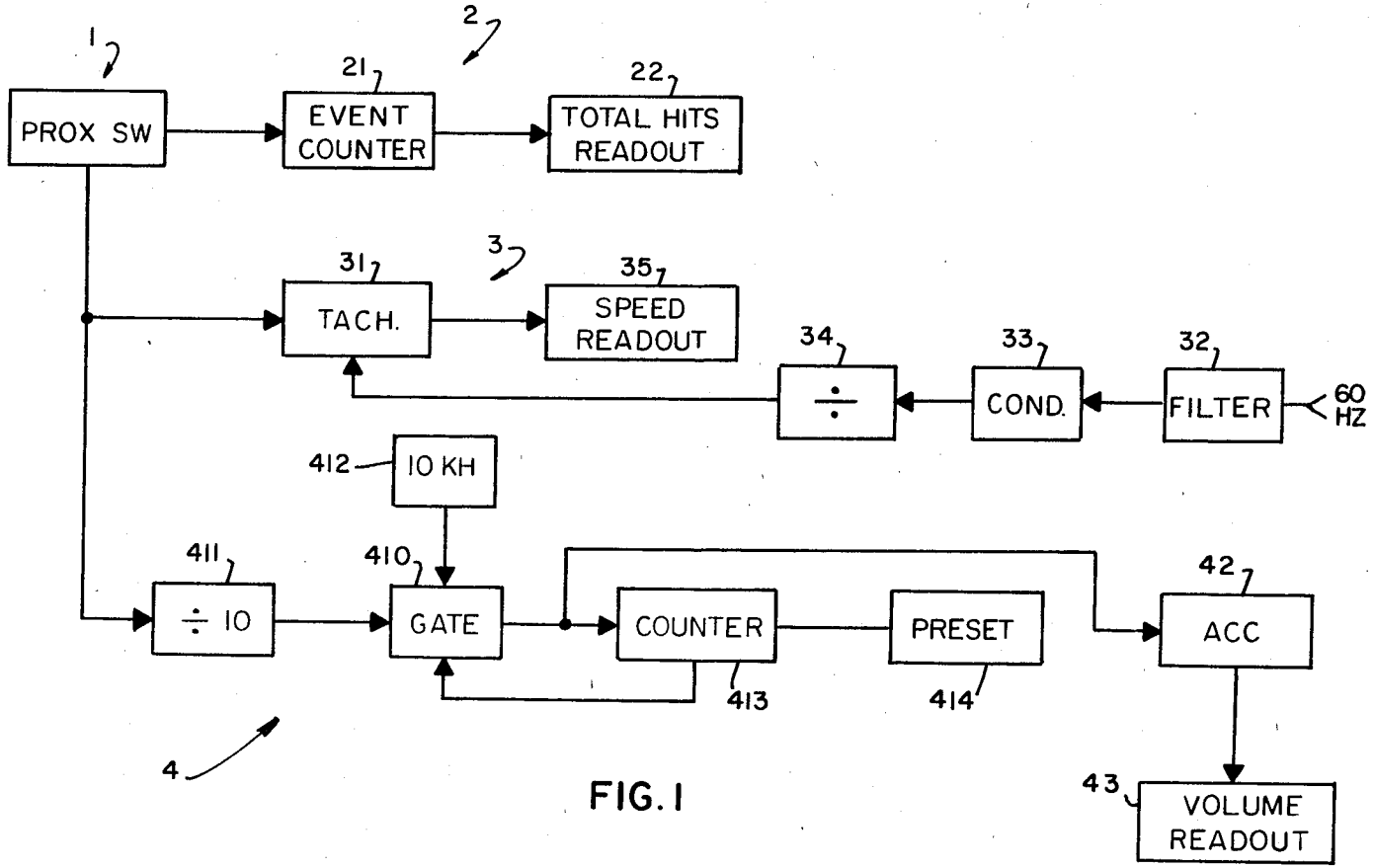
FIG. 1 is a schematic diagram of the subject invention.

For a better understanding of the present invention, together with the objects, advantages and capabilities thereof, reference is made to the following disclosure and appended claims together with the above-described drawing.

Referring now to FIG. 1, the subject invention is seen to include a mechanism 1, e.g., a proximity switch, sensitive to the operation of a press (not shown) so as to indicate the occurrence or completion of a stroke of the press. The proximity switch provides an indicator in the form of, for example, a contact closure or specified electrical output signal, that a specific point in the operating cycle of the press has obtained. Clearly devices other than the relatively simple mechanical proximity switch are contemplated by the invention and the term "proximity switch" is herein properly construed as including all types of devices suitable for indicating operation of the press as specified above.

The proximity switch 1 is coupled to a Total Hits Counter 2, including an event counter 21 and readout device 22, for indicating the total number of strokes of the press. In practice the proximity switch is configured so as to provide a positive, 12-volt, pulse upon each stroke of the press. The sequence of pulses is coupled to the input of the event counter so that the event count is accordingly incremented one count in response to each pulse from the proximity switch. The even counter drives an LED readout device 22 so that the readout displays the total number of press strokes.

The positive-pulse output of the proximity switch is also coupled to a mechanism 3 for indicating the number of strokes of the press occurring during a predetermined period of time. The mechanism includes a tachometer 31 that counts pulses under the control of a timebase generator derived from the 60 Hz AC line. 12-volt timebase pulses are derived from the 60 Hz line via a filter 32, line conditioner 33 and divider 34. A divide-by-3600 is provided so that timebase pulses are coupled to the tachometer at one-time intervals. As a result, the tachometer counts the number of press cycles per minute. At the end of a one-minute period, the timebase pulse latches the tachometer reading into a display device 35 and resets the tachometer so that press cycles can be monitored throughout the succeeding one-minute periods. The above sequence is repeated for successive one-minute periods so that a continuous reading of press speed is acquired.

In addition, a mechanism 4 is provided in order to monitor and indicate the total product output of the press. Mechanism 4 includes an "N-Pulser" driven by the proximity switch, the N-Pulser operating so as to repeatedly fill an accumulator 422 with a number of pulses, N, related to the amount of product produced during a machine cycle. In this way the accumulator maintains a running total of the amount of product produced.

The N-pulser includes a gate 410 having an enable input coupled through a divider 411 to the proximity switch. Ignoring for the moment the effect of the divider, pulses from the proximity switch operate to "open" the gate so that a periodic pulse train developed by a 10 KHz clock, 412, coupled to the signal input of the gate, is permitted to pass through the gate and be applied to both a counter 413 of the N-pulser as well as the accumulator. The counter is preset, via presetting means 414, which may assume the form of a thumbwheel switch, to a value related to the amount of product produced during a press cycle. Pulses at the output of the gate cause the counter to count through a sequence of states from the preset state to a "ZERO" state. The ZERO state of the counter causes a disabling signal to be applied to a disable input of the gate so that additional pulses of clock 412 are prevented from reaching the input of the counter or the accumulator until the next occurrence of a pulse at the enabling input of the gate.

Specifically, assuming that the divider 411 is characterized by a division ratio of ten and that 0.012 meters of product is produced during a machine cycle, (a machine cycle being one complete stroke of the press) the thumbwheel will be set, and the counter preset, to 12 so that as a result of every ten cycles of the press a value of 12 will be added to the accumulator. A readout device 43 coupled to the accumulator has a decimal point appropriately hardwired so that the display indicates an addition of twelve hundredths of a meter for each ten cycles of the press.

To reiterate, for a press operating at six hundred strokes per minute and a divider ratio of 10, every tenth stroke of the press, occurring at approximately once per second, will open the gate and cause twelve pulses to pass through to the counter and accumulator. After the twelfth pulse the counter will reach a "ZERO" state and the gate will be closed and remain so until the next pulse from the proximity switch is applied to the enable input of the gate. The pulse period, of clock 412, equal to the inverse of the clock frequency, 10 KHz, is chosen to be sufficiently shorter than the cycle time of the press so that the total number of pulses, N, are "dumped" into the accumulator between each occurrence of a pulse, at each tenth cycle of the press, at the enabling input of gate 410. Clearly, as the stroke cycle time varies, either the divider ratio or the preset value determined by the thumbwheel switch can be modified accordingly.

Accordingly, while there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention is useful in electronic instrumentation for automatically monitoring the operation of punch presses and similar machinery.

What is claimed is:

1. An apparatus for indicating the total amount of product produced by a press, said apparatus comprising:

stroke indicating means comprising a proximity switch sensitive to the operation of said press so as to indicate the occurrence of a stroke of said press;

an N-pulser coupled to said stroke indicating means for providing at an output a digital signal related to the amount of product produced during a stroke of said press, said N-pulser comprising a counter;

presetting means coupled to said counter for presetting said counter to a state determined by the amount of product produced as a result of each stroke of said press;

a clock;

a gate having an enable input coupled to said proximity switch, a signal input coupled to said clock, an output coupled to an input of said counter, and a disable input coupled to an output of said counter whereby said gate is opened in response to said proximity switch, thereby allowing said output of said clock to be coupled to the input of said counter, and closed when said counter has achieved a specified output state;

an accumulator coupled to the output of said gate for maintaining a running total of the product produced by said press; and a readout device coupled to said accumulator.

2. An apparatus as defined in claim 1 wherein the enable input of the gate is coupled to the proximity switch through a divider.

* * * * *